US007552921B2

(12) United States Patent
Spatafora

(10) Patent No.: US 7,552,921 B2
(45) Date of Patent: Jun. 30, 2009

(54) METHOD AND DEVICE FOR FEEDING SHEETS TO A USER MACHINE

(75) Inventor: Mario Spatafora, Granarolo (IT)

(73) Assignee: G.D. Societa'per Azioni (IT)

( * ) Notice: Subject to any disclaimer, the term of this patent is extended or adjusted under 35 U.S.C. 154(b) by 68 days.

(21) Appl. No.: 11/674,711

(22) Filed: Feb. 14, 2007

(65) Prior Publication Data

US 2007/0241494 A1 Oct. 18, 2007

(30) Foreign Application Priority Data

Feb. 14, 2006 (IT) ..... BO2006A0112

(51) Int. Cl.
*B65H 1/18* (2006.01)

(52) U.S. Cl. ..... 271/153; 271/149; 271/150; 271/152

(58) Field of Classification Search ..... 271/149–155
See application file for complete search history.

(56) References Cited

U.S. PATENT DOCUMENTS

| | | | | |
|---|---|---|---|---|
| 3,680,854 | A * | 8/1972 | Daily et al. | 271/146 |
| 3,767,189 | A * | 10/1973 | Kopp | 271/166 |
| 3,995,851 | A | 12/1976 | Casper | |
| 4,052,052 | A * | 10/1977 | Muller | 271/157 |
| 4,302,000 | A * | 11/1981 | Frank | 271/150 |
| 4,323,230 | A * | 4/1982 | Rising | 271/12 |
| 4,588,180 | A * | 5/1986 | Ballestrazzi et al. | 271/5 |
| 4,884,797 | A * | 12/1989 | Svyatsky | 271/126 |
| 4,919,412 | A * | 4/1990 | Weigel et al. | 271/110 |
| 4,928,942 | A * | 5/1990 | Aiuola et al. | 271/3.01 |
| 5,131,899 | A * | 7/1992 | Nagahashi et al. | 493/317 |
| 6,182,962 | B1 * | 2/2001 | Leuthold | 271/152 |
| 6,203,004 | B1 * | 3/2001 | Spatafora et al. | 271/31 |
| 6,260,841 | B1 * | 7/2001 | Tranquilla | 271/127 |
| 6,290,453 | B1 * | 9/2001 | Corniani et al. | 414/798.9 |
| 6,533,261 | B2 * | 3/2003 | Katou et al. | 271/3.12 |
| 6,644,649 | B1 * | 11/2003 | Chaume et al. | 271/152 |
| 6,896,255 | B1 * | 5/2005 | Fick et al. | 271/126 |
| 7,182,332 | B2 * | 2/2007 | Pittelkow | 271/150 |

FOREIGN PATENT DOCUMENTS

FR 2 692 874 12/1993

OTHER PUBLICATIONS

Search Report issued by European Patent Office on May 22, 2007, in connection with corresponding European Patent Application 07 10 2191.

* cited by examiner

*Primary Examiner*—Patrick H Mackey
*Assistant Examiner*—Prasad V Gokhale
(74) *Attorney, Agent, or Firm*—Ostrolenk, Faber, LLP

(57) ABSTRACT

A method and device for feeding sheets to a user machine, whereby the sheets, arranged in a stack along a channel having a substantially horizontal longitudinal axis, are fed to a single-sheet pickup member by dividing the stack into an output portion, an intermediate portion, and an input portion; pushing the output portion towards the pickup member at a given constant first pressure; compressing the input portion at a given second pressure; transferring sheets from the intermediate portion to the output portion to compensate for the withdrawn sheets and keep a length of the output portion substantially constant and equal to a given value; and transferring sheets from the input portion to the intermediate portion to keep the density of the sheets along the intermediate portion substantially constant and equal to a given value.

18 Claims, 1 Drawing Sheet

METHOD AND DEVICE FOR FEEDING SHEETS TO A USER MACHINE

The present invention relates to a method and device for feeding sheets to a user machine.

More specifically, the present invention relates to feeding relatively thin, small sheets to a user machine, and may be used to advantage for feeding revenue stamps or similar to a cigarette packing machine, to which the following description refers purely by way of example.

BACKGROUND OF THE INVENTION

In cigarette packing, stamps are fed successively to a pickup member of a packing machine by a feed device, in which the stamps are stacked inside a substantially horizontal channel having an outlet bounded laterally by shoulders and facing the pickup member.

In feed devices of this sort, a given thrust is exerted on the stack to compress it against the shoulders of the outlet and so ensure correct engagement of the stack by the pickup member.

Tests show that withdrawal of the stamps one by one, as opposed to groups of two or more at a time, is substantially only ensured when the stamps at the end of the stack facing the outlet are subjected to substantially constant pressure over and above a given value, and that this constant pressure cannot be achieved by simply exerting constant thrust on the stack in the direction of the outlet. The stack, in fact, when compressed, is deformed elastically, with an elastic response which, for a given material and thickness of the stamps, depends on the length of the stack, so that the pressure with which the stack adheres to the shoulders of the outlet varies as the stack is used up, even if the stack is subjected to constant thrust.

It has been proposed to eliminate this drawback by continuously determining the contact pressure of the stack on the lateral shoulders of the outlet, and applying thrust by means of a variable-thrust pressure member feedback-controlled to keep the contact pressure equal to a given reference value.

Unfortunately, this solution, too, has not been altogether successful. The stack, in fact, when compressed, behaves like an elastic block with a relatively high degree of hysteresis varying with the length of the stack, and feedback thrust control causes the contact pressure to assume a mean value substantially equal to the reference value, but to oscillate continually and uncontrollably about the reference value, thus preventing withdrawal of the stamps one by one.

SUMMARY OF THE INVENTION

It is an object of the present invention to provide a feed method and device designed to at least partly eliminate the aforementioned drawbacks, and which, at the same time, are cheap and easy to implement.

According to the present invention, there are provided a method and device as claimed in the attached Claims.

BRIEF DESCRIPTION OF THE DRAWING

The present invention will be described with reference to the attached drawing, which shows a schematic view of a non-limiting embodiment, identified as FIG. 1.

DETAILED DESCRIPTION OF THE INVENTION

Figure 1:
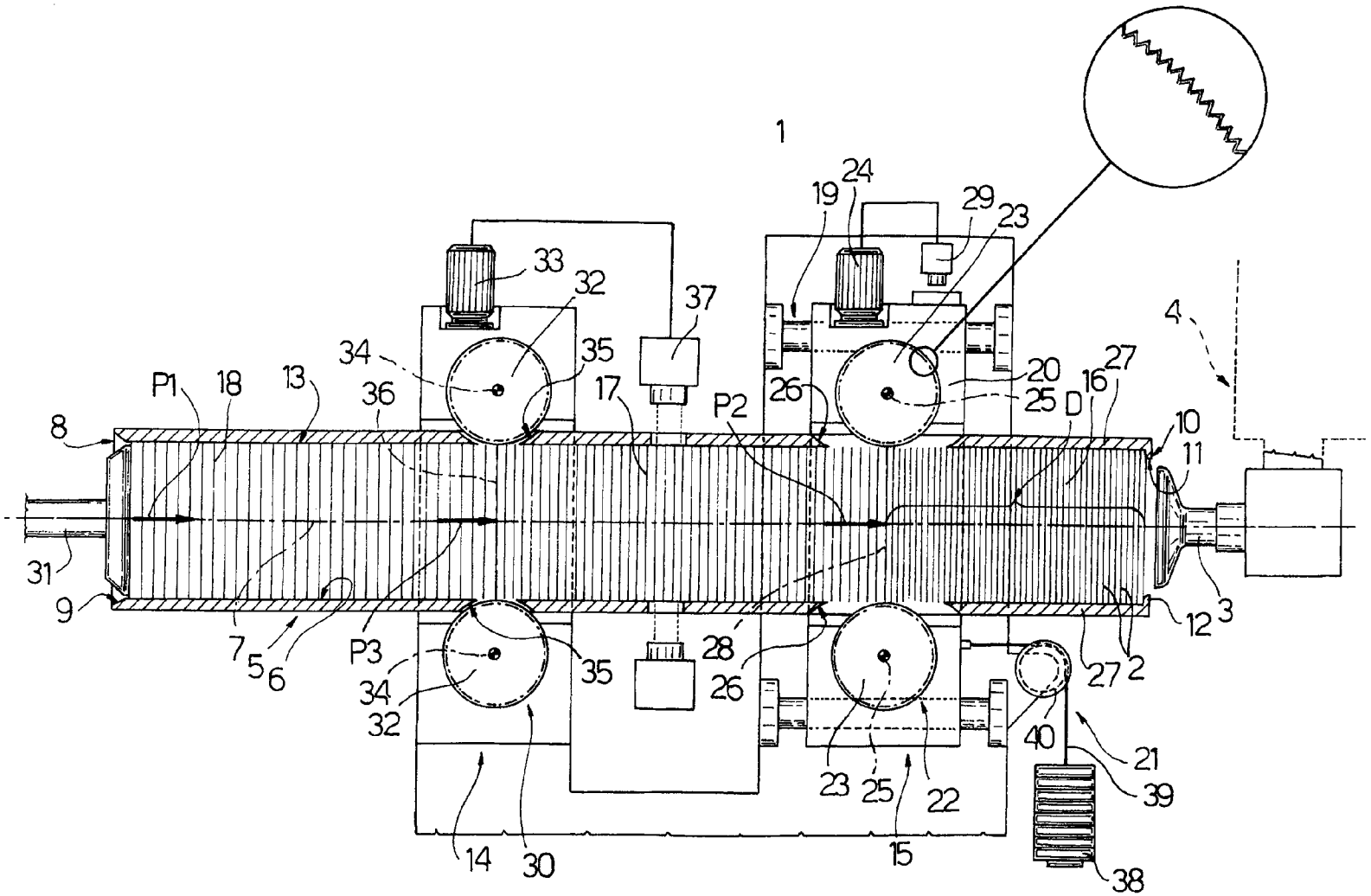

In FIG. 1, number 1 in the attached drawing indicates as a whole a device for feeding stamps 2, in particular, revenue stamps, to a known pickup member 3 of a packing machine 4, in particular, a cigarette packing machine.

Device 1 comprises a conduit 5 defining, internally, a channel 6 having a substantially horizontal longitudinal axis 7 and comprising an input end 8 having an inlet 9; and an output end 10 having an outlet 11 bounded laterally by two lateral shoulders 12 and facing pickup member 3.

Channel 6 houses a stack 13 of stamps 2 positioned crosswise to longitudinal axis 7, and device 1 comprises two stop devices 14 and 15, which are located along conduit 5, with stop device 15 interposed between stop device 14 and outlet 11, and cooperate laterally with stack 13 to divide it, in use, into an output portion 16 extending between stop device 15 and outlet 11, an intermediate portion 17 extending between stop devices 14 and 15, and an input portion 18 extending between stop device 14 and inlet 9.

Stop device 15 comprises a rail 19 extending along channel 6, parallel to longitudinal axis 7; and a carriage 20, which is mounted on and runs idly along rail 19, is connected to a thrust device 21 for exerting constant thrust on carriage 20 towards inlet 9, and supports an engaging device 22 for laterally engaging stack 13 to separate output portion 16 from intermediate portion 17, and for transmitting said constant thrust to output portion 16 in the direction of lateral shoulders 12.

Engaging device 22 comprises two rollers 23, which are located on opposite sides of channel 6, are supported by carriage 20, are powered by a motor 24 to rotate in opposite directions about respective axes 25 perpendicular to longitudinal axis 7, and engage respective longitudinal openings 26 in respective lateral walls 27 of conduit 5, so as to be positioned, in use, laterally contacting stack 13 along a partition plane 28 perpendicular to longitudinal axis 7 and separating output portion 16 from intermediate portion 17.

In actual use, partition plane 28 moves with carriage 20 along rail 19, and motor 24 is feedback-controlled by a sensor 29, for determining the distance between partition plane 28 and lateral shoulders 12 and, therefore, the length of output portion 16, so as to roll rollers 23 along stack 13 and draw carriage 20 along rail 19 to keep the length of output portion 16 substantially equal to a given value.

To ensure positive engagement of stack 13 by rollers 23, rollers 23 are made of any material but knurled on the outside, or, in a variation not shown, are smooth but made of elastomeric material.

Stop device 14 is located in a fixed position along channel 6, and comprises a powered engaging device 30 for laterally engaging stack 13 to separate input portion 18 from intermediate portion 17, and for absorbing a given axial thrust exerted on input portion 18 by a pressure member 31 acting on stack 13 through inlet 9.

Engaging device 30 comprises two rollers 32, which are located on opposite sides of channel 6, are powered by a motor 33 to rotate in opposite directions about respective axes 34 perpendicular to longitudinal axis 7, and engage respective openings 35 in respective lateral walls 27 of conduit 5, so as to be positioned, in use, laterally contacting stack 13 along a partition plane 36 perpendicular to longitudinal axis 7 and separating input portion 18 from intermediate portion 17.

In actual use, partition plane 36 is fixed, and motor 33 is feedback-controlled by a sensor 37, for determining the density of stamps 2 along intermediate portion 17, so as to roll rollers 32 in opposite directions about respective axes 34 to riffle stack 13, and transfer stamps 2 through partition plane 36 from input portion 18 to intermediate portion 17 to keep the density of stamps 2 along intermediate portion 17 substantially equal to a given value.

In this case, too, to ensure positive engagement of stack 13 by rollers 32, rollers 32 are made of any material but knurled on the outside, or, in a variation not shown, are smooth but made of elastomeric material.

In actual use, pressure member 31 subjects input portion 18 to a relatively high pressure P1, which is entirely absorbed by rollers 32 and not transmitted to intermediate portion 17 through partition plane 36. At the same time, thrust device 21—shown schematically as a weight 38 connected to carriage 20 by a cable 39 wound about a pulley 40—subjects output portion 16, by means of rollers 23 engaging stack 13, to a constant pressure P2 normally, though not necessarily, lower than P1; whereas intermediate portion 17 is subjected to no direct pressure. Therefore, the pressure, indicated P3, on stamps 2 in intermediate portion 17 may be assumed to be relatively low and substantially zero, and in any case lower than both P1 and P2.

In these conditions, which may be assumed starting conditions, partition plane 28 is separated from shoulders 12 by a distance D substantially equal to a reference value.

When pickup member 3 begins withdrawing individual stamps 2 successively in known manner from output portion 16 of stack 13 through outlet 11, output portion 16 gets shorter, so that carriage 20 moves towards shoulders 12. This movement is immediately detected by sensor 29, which activates motor 24 and rotation of rollers 23, which roll along stack 13 to restore distance D to the reference value. As they roll along, rollers 23 riffle stack 13 to transfer a certain number of stamps 2 from intermediate portion 17 to output portion 16 and so reduce the density of stamps 2 along intermediate portion 17. This change in density is detected by sensor 37 and immediately compensated by activation of motor 33, which rotates rollers 32, which riffle stack 13 to transfer a certain number of stamps 2 from input portion 18 to intermediate portion 17. When the length of input portion 18 falls below a given value, further stamps 2 are loaded through inlet 9 by removing pressure member 31, and without disturbing the distribution of stamps 2 along intermediate portion 17 and input portion 16, and with no variation in distance D.

As stamps 2 are fed to packing machine 4, it is therefore possible to maintain a constant distance D, a constant pressure P1, and, therefore, constant withdrawal conditions of stamps 2 through outlet 11.

The invention claimed is:

1. A method of feeding sheets to a user machine, the sheets being arranged in a stack along a channel having a substantially horizontal longitudinal axis, an input end, and an output end, and having, at the output end, an outlet facing a single-sheet pickup member; the method comprising the steps of:

separating, along the stack and at a first partition plane, an output portion terminating at the outlet;

compressing the output portion at a given constant first pressure towards the outlet; and moving the first partition plane towards the input end and against the first pressure to compensate for the sheets withdrawn through the outlet by the pickup member, and keep a length of the output portion substantially constant and equal to a first given value.

2. A method as claimed in claim 1, and comprising the further steps of:

dividing the stack, not only at the first partition plane, but also at a second partition plane to define, along the stack, in addition to the output portion, also an intermediate portion and an input portion;

compressing the input portion at a given second pressure; and transferring sheets from the input portion to the intermediate portion to keep a density of the sheets along the intermediate portion substantially constant and equal to a given second value.

3. A method as claimed in claim 2, wherein the value of the density of the sheets along the intermediate portion is chosen so that the sheets along the intermediate portion are subjected to a third pressure lower at all times than the first pressure.

4. A method as claimed in claim 2, wherein the value of the density of the sheets along the intermediate portion is chosen so that the sheets along the intermediate portion are subjected to a third pressure lower at all times than the second pressure.

5. A method as claimed in claim 2, wherein the second pressure is applied by pushing the input portion against a second stop device cooperating with the stack at the second partition plane.

6. A method as claimed in claim 5, wherein the second partition plane is located in a fixed position along the channel.

7. A method as claimed in claim 5, wherein the sheets are transferred from the input portion to the intermediate portion by the second stop device moving the sheets, located instant by instant in said fixed position along the channel, towards the outlet, in response to detection of a density of the sheets below the second value along the intermediate portion.

8. A method as claimed in claim 1, wherein the first pressure is applied by a first stop device, which defines the first partition plane, is movable to move the first partition plane along the channel, is subjected to constant thrust towards the outlet, and cooperates with the stack to apply the first pressure to the output portion.

9. A device for feeding sheets, arranged in a stack, to a single-sheet pickup member of a user machine, the device comprising:

a conduit defining a channel, which houses the stack, has a substantially horizontal longitudinal axis, an input end, and an output end, and comprises, at the output end, a narrow-section outlet positioned facing the single-sheet pickup member and defined laterally by at least one shoulder supporting the stack;

the device being characterized by comprising a first stop device cooperating with the stack to define, along the stack and at a first partition plane, an output portion terminating at the outlet; the first stop device being mounted to move along the channel, and comprising thrust means for applying constant thrust to the first stop device towards the outlet, and powered first engaging means which engage the stack to define the first partition plane, to apply a constant first pressure to the output portion as a function of said thrust, and to move the first partition plane along the stack to keep a length of the output portion substantially constant and equal to a given first value; and also comprising a second stop device located in a fixed position along the channel and cooperating with the stack to define, along the stack and at a second partition plane, an input portion, and an intermediate portion interposed between the input portion and the output portion; the second stop device comprising powered second engaging means, which engage the stack to define the second partition plane, and to transfer sheets from the input portion to the intermediate portion to keep a density of the sheets along the intermediate portion substantially constant and equal to a given second value;

wherein the first stop device comprises first sensor means for determining the length of the output portion; and the powered first engaging means comprise two powered first rollers, which are located on opposite sides of the channel, are fitted to the carriage to rotate in opposite directions about respective first axes perpendicular to the longitudinal axis, and are positioned contacting the stack along the first partition plane, which moves with the carriage along the rail; the first rollers being feedback-controlled by the first sensor means to roll along the stack and draw the carriage along the rail to keep the length of the output portion substantially equal to the given first value.

10. A device as claimed in claim 9, and also comprising pressure means for compressing the input portion at a given second pressure against the second stop device.

11. A device as claimed in claim 9, wherein the first stop device comprises a rail extending along the channel, parallel to the longitudinal axis; and a carriage fitted to the rail to run idly along the rail; the carriage supporting the first engaging means, and being connected to the thrust means.

12. A device as claimed in claim 9, wherein the two first rollers are knurled rollers.

13. A device as claimed in claim 9, wherein the two first rollers are made of elastomeric material.

14. A device as claimed in claim 9, wherein, for each first roller, the conduit has a lateral longitudinal opening allowing the first roller into the channel.

15. A device for feeding sheets, arranged in a stack, to single-sheet pickup member of a user machine, the device comprising:

a conduit defining a channel, which houses the stack, has a substantially horizontal longitudinal axis, an input end, and an output end, and comprises, at the output end, a narrow-section outlet positioned facing the single-sheet pickup member and defined laterally by at least one shoulder supporting the stack;

the device being characterized by comprising a first stop device cooperating with the stack to define, along the stack and at a first partition plane, an output portion terminating at the outlet; the first stop device being mounted to move along the channel, and comprising thrust means for applying constant thrust to the first stop device towards the outlet, and powered first engaging means which engage the stack to define the first partition plane, to apply a constant first pressure to the output portion as a function of said thrust, and to move the first partition plane along the stack to keep a length of the output portion substantially constant and equal to given first value; and also comprising a second stop device located in a fixed position along the channel and cooperating with the stack to define, along the stack and at a second partition plane, an input portion, and an intermediate portion interposed between the input portion and the output portion; the second stop device comprising powered engaging means, which engage the stack to define the second partition plane, and to transfer sheets from the input portion to the intermediate portion to keep a density of the sheets along the intermediate portion substantially constant and equal to a given second value;

wherein the second stop device comprises second sensor means for determining the density of sheets along the intermediate portion; and the powered second engaging means comprises two second rollers, are located on opposite sides of the channel to rotate in opposite directions about respective fixed second axes perpendicular to the longitudinal axis, are positioned contacting the stack along the second partition plane, and are feedback-controlled by the second sensor means to riffle the stack and keep the density of the sheets along the intermediate portion substantially constant and equal to the given second value.

16. device as claimed in claim 15, wherein the two second rollers are knurled rollers.

17. A device as claimed in claim 15, wherein the two second rollers are made of elastomeric material.

18. A device as claimed in claim 15, wherein, for each second roller, the conduit has a lateral opening allowing the second roller into the channel.

* * * * *